US009381572B2

(12) United States Patent
Reinhart

(10) Patent No.: US 9,381,572 B2
(45) Date of Patent: Jul. 5, 2016

(54) IMPACT PAD

(75) Inventor: Jeffrey R. Reinhart, Huron, OH (US)

(73) Assignee: Vesuvius Crucible Company, Wilmington, DE (US)

( * ) Notice: Subject to any disclaimer, the term of this patent is extended or adjusted under 35 U.S.C. 154(b) by 183 days.

(21) Appl. No.: 14/123,792

(22) PCT Filed: Apr. 12, 2012

(86) PCT No.: PCT/US2012/033265

§ 371 (c)(1), (2), (4) Date: Dec. 4, 2013

(87) PCT Pub. No.: WO2012/173690

PCT Pub. Date: Dec. 20, 2012

(65) Prior Publication Data

US 2014/0117057 A1 May 1, 2014

Related U.S. Application Data

(60) Provisional application No. 61/496,974, filed on Jun. 14, 2011.

(51) Int. Cl.
*B22D 41/00* (2006.01)

(52) U.S. Cl.
CPC ..... *B22D 41/003* (2013.01)

(58) Field of Classification Search
CPC ..... B22D 41/003
USPC ..... 266/236
See application file for complete search history.

(56) References Cited

U.S. PATENT DOCUMENTS

| | | | | |
|---|---|---|---|---|
| 4,653,733 | A | 3/1987 | Bugajski et al. | |
| 5,131,635 | A | 7/1992 | Soofi | |
| 5,169,591 | A | 12/1992 | Schmidt et al. | |
| 6,102,260 | A | 8/2000 | Heaslip et al. | |
| 6,929,775 | B2 | 8/2005 | Connors, Sr. | |
| 6,997,361 | B2 | 2/2006 | Zacharias et al. | |
| 2002/0033567 | A1 | 3/2002 | Morales et al. | |
| 2014/0117057 | A1* | 5/2014 | Reinhart | 222/594 |

FOREIGN PATENT DOCUMENTS

| | | | |
|---|---|---|---|
| EP | 1955794 | A1 | 8/2008 |
| EP | 2047928 | A1 | 4/2009 |
| JP | 2003-501266 | | 1/2003 |

* cited by examiner

*Primary Examiner* — Scott Kastler
(74) *Attorney, Agent, or Firm* — Thomas Clinton; Donald M. Satina

(57) ABSTRACT

A tundish impact pad formed from refractory material comprises a base having an impact surface which, in use, faces upwardly against a stream of molten metal entering a tundish, and a wall extending upwardly from the base around at least a part of the periphery of the impact surface. The wall has at least one latitudinal portion. An inwardly-extending feature protrudes from the latitudinal wall. The inwardly-extending feature inhibits flow exiting the impact pad from passing over the center of the latitudinal portion of the wall.

18 Claims, 5 Drawing Sheets

IMPACT PAD

BACKGROUND OF THE INVENTION (1) Field of the Invention

The present invention relates to a refractory article known in the art as an "impact pad" for use in handling molten metals, especially steel. The invention particularly relates to an impact pad for placement in a tundish for reducing turbulence in a flow of molten steel entering the tundish. The present invention finds particular utility in the continuous casting of steel.

(2) Description of the Related Art

Tundishes act as holding tanks for said molten metal, and especially for molten steel in commercial processes for the continuous casting of steel. In the continuous casting of steel, the molten steel fed to the tundish is generally high-grade steel that has been subjected to various steps for rendering it suitable for the particular casting application. Such steps normally involve, for example, one or more steps to control the levels of the various elements present in the steel, for example the level of carbon or other alloying ingredients, and the level of contaminants such as slag. The residence of the steel in the tundish provides a further opportunity for any entrained slag and other impurities to segregate and float to the surface where they can be, for example, absorbed into a special protective layer provided on the surface of the molten steel. Thus the tundish can be used to further "clean" the steel before it is fed to the mould for casting.

To optimize the ability of the tundish to continuously furnish a supply of clean steel to the mould, it is highly desirable to control and streamline the flow of steel through the tundish. Molten steel is normally fed to the tundish from a ladle via a shroud that protects the stream of steel from the surrounding atmosphere. The stream of molten steel from the ladle generally enters the tundish with considerable force, and this can generate considerable turbulence within the tundish itself. Any undue turbulence in the flow of molten steel through the tundish has a number of undesirable effects including, for example; preventing slag and other undesirable inclusions in the steel from agglomerating and floating to the surface; entraining into the molten steel a part of the protective crust that forms, or is specifically provided, on the surface of thereof; entraining gas into the molten steel; causing undue erosion of the refractory lining within the tundish; and generating an uneven flow of the molten steel to the casting mould.

In an effort to overcome these problems the industry has undertaken extensive research into various designs of impact pads for reducing turbulence in the tundish arising from the incoming stream of molten steel, and for optimizing the flow within the tundish to approximate ideal "plug flow" characteristics as nearly as possible of the molten steel as it traverses the tundish. Generally speaking it has been found that the flow of molten steel through the tundish can often be improved using impact pads that have specially designed surfaces capable of redirecting and streamlining the flow of molten steel.

Plug flow behavior (i.e., passage of successive portions of steel through the tundish without significant mixing) requires direction of flow away from the tundish outlet after the molten steel recedes from the impact pad. The presence of a significant portion of flow from the impact pad to the tundish outlet, with a minimized residence time in the tundish, is known as "short-circuiting." Impact pads disclosed in the prior art have generally been designed with particular attention to the upwardly directed component of the resulting flow. An increase in the residence time, and an increase in the uniformity of residence time, in the tundish corresponds to the minimization of mixing, and enables successive steel formulations to pass through the tundish with retention of their respective compositions.

Impact pads disclosed in the prior art generally comprise a base against which a downwardly directed stream of molten steel impinges, and a vertical sidewall or sidewall elements that redirect the stream. They are fabricated from refractory materials capable of withstanding the corrosive and erosive effects of a stream of molten steel for their working lives. They are frequently shaped in the form of shallow boxes having, for example, square, rectangular, trapezoidal or circular bases.

It will be appreciated that the process of designing a new tundish impact pad which meets particular pre-determined criteria is extremely complex, since changing one aspect of the design of an impact pad generally has unforeseen ramifications on the flow dynamics of the entire tundish system.

BRIEF SUMMARY OF THE INVENTION

It is an object of the present invention to provide an improved impact pad suitable for placement in a tundish for increasing the residence time, inducing uniformity of residence time, and minimizing short-circuiting, of the flow of molten metal introduced therein.

The present invention provides a tundish impact pad formed from refractory material comprising a base having an impact surface which, in use, faces upwardly against a stream of molten metal entering a tundish, a wall extending upwardly from the base around at least a part of the periphery of the impact surface having a latitudinal portion, a longitudinal portion in certain embodiments, and an inwardly extending feature protruding from the latitudinal portion of the wall. In certain embodiments of the invention, the inwardly extending feature may take the form of a protrusion, which may have a width less than the extent of the latitudinal portion of the wall. In embodiments in which the protrusion has a width less than the extent of the latitudinal portion of the wall, and in the presence of a longitudinal portion of the wall, a flow channel is formed between the longitudinal portion of the wall and an adjacent portion of the surface of the protrusion.

The present invention may also be described as a tundish impact pad formed from refractory material comprising a base having an impact surface which, in use, faces upwardly against a stream of molten metal entering a tundish, and a wall extending upwardly from the base around at least a part of the periphery of the impact surface, the base and the wall defining an interior, the pad having a longitudinal central minimum extent, the wall having a longitudinal portion having an interior, an internal extent and an internal length, and a latitudinal portion having an interior, an internal extent and an internal length, wherein the internal extent of the longitudinal portion of the wall is greater than the longitudinal central minimum extent of the pad, and wherein the internal length of the latitudinal portion of the wall is greater than the internal extent of the latitudinal portion of the wall. The internal extent of a wall is the straight-line measurement from one end of the interior of a wall to the other; the internal length of a wall is the distance along the interior surface of the wall from one end of the wall to the other The present invention may also be described as a tundish impact pad having a base and a latitudinal wall extending upwardly from the base. The impact pad is distinguished by producing, in use, flow velocities of fluid across the top of the latitudinal wall that exhibit a minimum at a central portion of the latitudinal portion of the wall in the absence of any variation in wall height.

The wall may extend partially around the periphery of the base, or may extend around the entire periphery of the base. In certain embodiments wherein the wall extends around the entire periphery of the base, the wall has a uniform height. The wall may be vertical or have an angle in the range from, and including, 1 degree to, and including, 30 degrees from the vertical.

One or more portions of the upper part of the wall may support one or more overhangs which project inwardly over the periphery of the base.

The protrusion may take the form of a shoulder, whereby the protrusion may protrude form a longitudinal portion of the wall as well as from a latitudinal portion of the wall.

The protrusion may be configured and arranged in various ways. The protrusion may be centered on the latitudinal wall, or may be disposed off-center on the latitudinal wall. In one embodiment, the interior surface of the protrusion intersects the interior of the latitudinal portion of the wall at an angle greater than 90 degrees. The interior surface of the protrusion may be composed entirely of planar surfaces, may contain at least one quadrilateral surface, may contain one or more rectangular surfaces, may be composed entirely of rectangular surfaces, may have the form of a radial surface of a cylinder, or may have a parabolic horizontal section. The ratio of the width of the protrusion to the height of the protrusion may be 1 or greater, may have a value in the range from, and including 0.8 to, and including, 1.5, or may have a value in the range from, and including 0.8 to, and including, 2. The ratio of the width of the protrusion to the internal extent of the latitudinal wall of the impact pad may be in the range from, and including, 0.1 to, and including, 1. The ratio of the extent of the protrusion to the width of the protrusion may be in the range from, and including 0.3 to, and including, 3. The interior surface of the protrusion may be vertical, or may have an angle from the vertical in the range of, and including 1 degree to, and including, 30 degrees. The height of the protrusion may equal the height of the portion of the latitudinal portion of the wall with which it is in contact, or may have a height ratio to the latitudinal wall portion in the range from, and including, 0.3 to, and including, 1.

The interior surface of a protrusion and the interior surface of a longitudinal portion of the wall may converge to form a flow channel having a floor, and having an end distal to the center of the impact pad. The distal end of the flow channel may be partially blocked; flow in the horizontal direction may be partially or fully obstructed and an overhang may partially obstruct flow in the vertical direction. The interior surface of the protrusion and the interior surface of the longitudinal portion of the wall may or may not intersect. The angle formed by the interior surface of the protrusion and the interior surface of the longitudinal portion of the wall may decrease towards the distal end of the flow channel. The decrease in angle may be continuous or incremental. The floor of the flow channel may increase in elevation as it extends towards the distal end of the flow channel. The floor of the flow channel may form an angle less than 180 degrees with the impact surface of the impact pad; this angle may be in the range from, and including, 110 degrees to, and including, 160 degrees, may be in the range from, and including, 115 degrees to, and including, 155 degrees, may be in the range from, and including, 120 degrees to, and including, 150 degrees, or may have values of 115, 120, 125, 127, 130, 135, 140, 145, 150 or 155 degrees.

The base of the impact pad can be of any suitable shape, for example, polyhedral shapes such as, for example, square, rectangular, trapezoidal, rhomboidal, hexagonal, octagonal, circular or elliptical.

The impact surface of the base is adapted to receive the main force of the flow of metal entering the tundish. It can be, for example, planar, concave or convex. The base itself can, if desired, be affixed to the base of a tundish using any suitable means, for example, using refractory cement, or by locating the base by means of corresponding elements formed in the surface of the refractory lining of the tundish and the underside of the impact pad. The impact pad may be embedded into the refractory base of the tundish. This can be achieved, for example, by placing the impact pad on the monolithic refractory lining of a tundish, placing a layer of cold cure or hot cure refractory power composition to surround the base and optionally part of the outer wall of the impact pad, and then curing the refractories to bind the impact pad in position in the tundish.

The wall extending upwardly from the base around at least a part of the periphery of the impact surface may be made from the same material as the base and may be integral therewith. At least one wall extending upwardly from the base around at least a part of the periphery of the impact surface may have a mirror image counterpart wall extending upwardly from the opposite peripheral part of the base.

In the case that the impact pad is intended for so-called "two strand" operation, the wall may extend around the entire periphery of the base. The wall may extend substantially perpendicular in relation to the base. Thus, a linear peripheral portion of the base may support a vertical planar wall portion, whereas a curved portion of the base may support a vertical wall having correspondingly curved horizontal cross section.

In the case that the impact pad has a rectangular or trapezoidal-shaped base and is intended for so called "single strand" operation, the wall may extend around three sides of the base, with the fourth side having either no wall, or a relatively low wall. The impact pad may be configured so that it has a single inwardly extending feature; in use, the impact pad may be installed in the tundish so that the inwardly extending feature is oriented adjacent to the tundish outlet.

One or more portions of the upper part of the wall may support one or more overhangs which project inwardly over the periphery of the base. The overhang may be in the form of an inner peripheral strip projecting inwardly from the wall. The peripheral strip may project from the top of the wall.

In the case that the impact pad is designed primarily for double strand operation, the overhang, e.g. a peripheral strip, may be omitted, may run along at least 50%, at least 75% or along 100% of the length of the wall. In the case that the impact pad is designed primarily for single strand operation, the overhang, e.g. a peripheral strip, may be omitted, may run along 50% to 100%, or 60 to 80% of the length of the wall.

An impact pad for single strand operation may have a single protrusion that will be located adjacent to the single tundish outlet. This configuration may have one flow channel or two flow channels located adjacent to the single tundish outlet. For two strand operation, an impact pad may have one or more flow channels located adjacent to each of the tundish outlets, i.e., on opposite latitudinal walls.

The upper surfaces of the overhang may be smooth surfaces. The upper surface can have a profile matching the profile of the under-surface if desired, e.g. to provide an overhang having a substantially uniform thickness at least in the portion occupied by the curved or sloping portion.

The junction between the wall and the impact surface (i.e. the upper surface of the base) can take the form of a sharp angle, e.g. a right angle, or an acute angle or an obtuse angle, or can be rounded or curved.

The impact pad according to the present invention can be made using the standard molding techniques well known in the art for forming refractory shaped articles. The impact pad can, if desired, be fabricated in two or more separate parts which can then be joined together to form the final article, or can be fabricated as a monolithic structure (i.e., formed in one piece as a single integral article).

The refractory material from which the impact pad is fabricated can be any suitable refractory material capable of withstanding the erosive and corrosive effects of a stream of molten metal throughout its working life. Examples of suitable materials are refractory concretes, for example concretes based on one or more particulate refractories, and one or more suitable binders. Refractories suitable for the manufacture of impact pads are well known in the art, for example alumina, magnesia and compounds or composites thereof. Similarly suitable binders are well known in the art, for example, high alumina cement.

Impact pads in accordance with the present invention can be made for use with tundishes operating in single strand, two strand or multi strand mode. As is well known in the art, continuous casting steel processes operating in single strand and multi strand (delta tundish) modes generally employ impact pads having square, rectangular or trapezoidal cross section (in the horizontal plane) wherein one pair of opposite sides are provided with walls having equal height, a third side also having a wall, and the fourth side either having a lower wall or no wall. In the double (or sometime quadruple or six-fold) strand technologies, the impact pads generally have square or rectangular cross section wherein a first pair of opposite sides are provided with walls having equal height, and the second pair of opposite sides are also of equal height (which may be the same as, or different from the height of the first pair). In single strand and multiple strand operation the impact pad is generally positioned near one end of the tundish to one side of the area wherein the outlet(s) for the molten steel are situated, whereas in double strand operation the impact pad is generally positioned in the center of a rectangular tundish with two outlets situated on opposite sides of the impact pad (or in quadruple strand operation, two pairs of outlets situated on opposite sides, or in six-fold strand operation, three pairs of outlets situated on opposite sides).

Impact pads in accordance with the present invention can be used, for example, to provide reduced dead volume and/or improved plug flow and/or reduced turbulence in tundishes for holding molten steel.

BRIEF DESCRIPTION OF THE SEVERAL VIEWS OF THE DRAWINGS

The invention will now be described with reference to the accompanying drawings wherein.

DETAILED DESCRIPTION OF THE INVENTION

Figure 1:
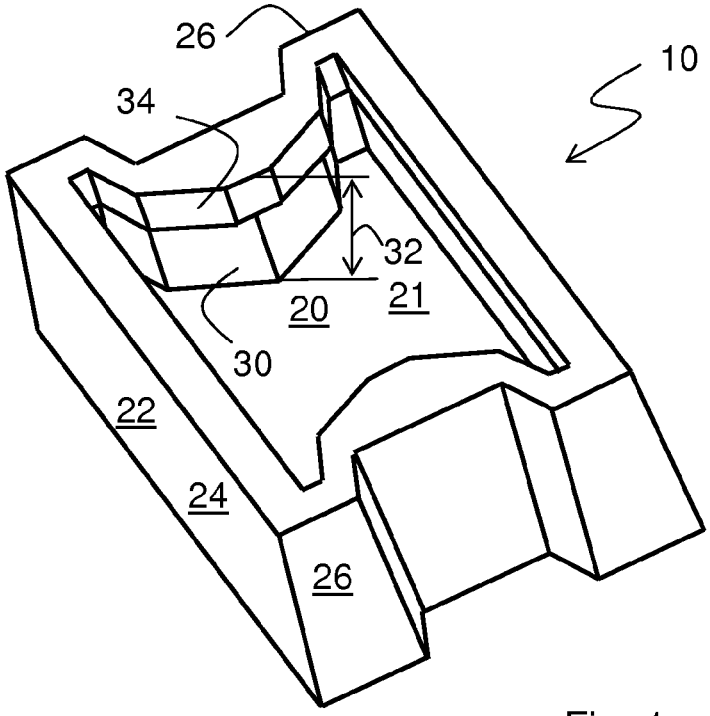
FIG. 1 is a perspective view of an impact pad of the present invention.

FIG. 1 shows an impact pad 10 comprising a base 20 having an impact surface 21 facing upwards towards an interior, and a wall 22 extending upwardly from base 20. The wall 22 has a longitudinal portion 24 and a latitudinal portion 26. A protrusion 30 extends inwardly, towards the center of the impact pad, from latitudinal portion 26. Protrusion height 32 is the distance between the impact pad impact surface 21 and the top of protrusion 30. Overhang 34 extends horizontally inwards from the top of wall 22.

Figure 2:
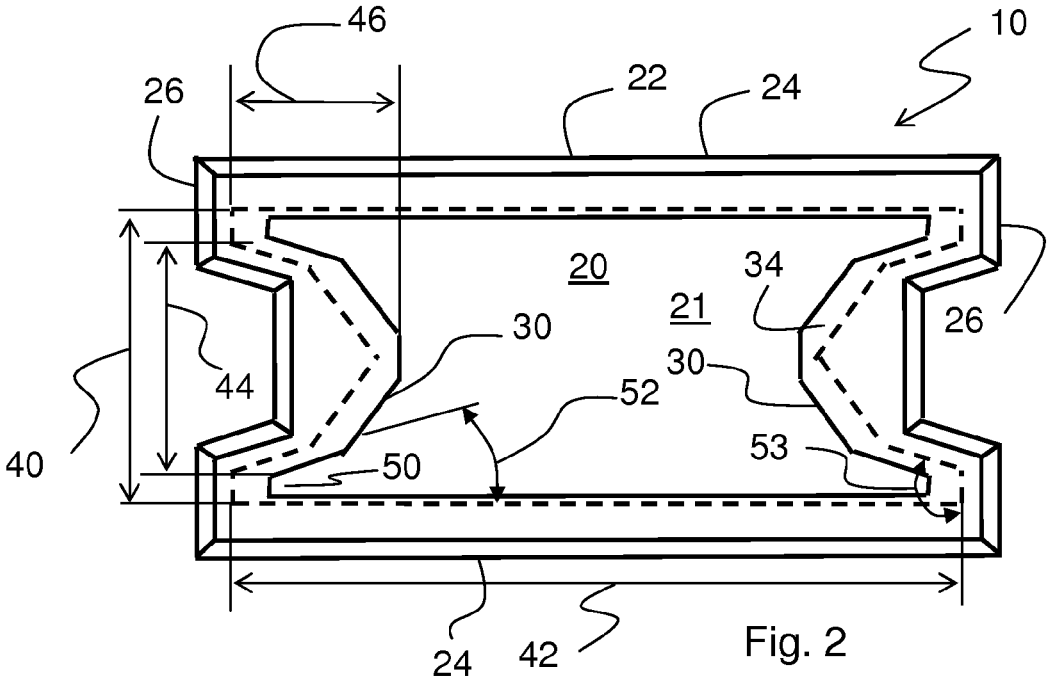
FIG. 2 is a plan view of an impact pad of the present invention.

FIG. 2 shows a plan view of an impact pad 10 of the present invention. Base 20 has an impact surface 21; wall 22 extends from the impact surface 21. Wall 22 is composed of longitudinal portions 24 and latitudinal portions 26. A pair of protrusions 30 extends inwardly, towards the center of the impact pad, each from latitudinal portions 26. Overhang 34 extends horizontally inwards from the top of wall 22. The interior of the latitudinal portion 26 has an extent 40 indicating the straight-line distance between the endpoints of the latitudinal portion. Protrusion width 44 indicates the straight-line distance between two intersections of the protrusion 30 with latitudinal wall portion 26. Protrusion extent 46 indicates the longitudinal distance between an intersection of the protrusion 30 with latitudinal wall portion 26 and the point on protrusion 30 furthest from latitudinal wall portion 26, inclusive of any portion of overhang 34 in direct contact with protrusion 26. Flow channel 50 is formed within an angle 52 produced by the convergence of the interior of a longitudinal portion 24 and protrusion 30. In this embodiment of the invention, successive segments of the protrusion 30 form successively smaller angles with the interior of longitudinal portion 24 as longitudinal portion 24 and protrusion 30 converge. In this embodiment of the invention, longitudinal portion 24 and protrusion 30 do not intersect; instead, longitudinal portion 24 and protrusion 30 each intersect an interior surface of latitudinal portion 26 of impact pad wall 22. The angle 53 is the angle of intersection of the interior surface of the protrusion with the interior of the latitudinal portion 26 of the wall; in the embodiment shown, the angle is greater than 90 degrees.

Figure 3:
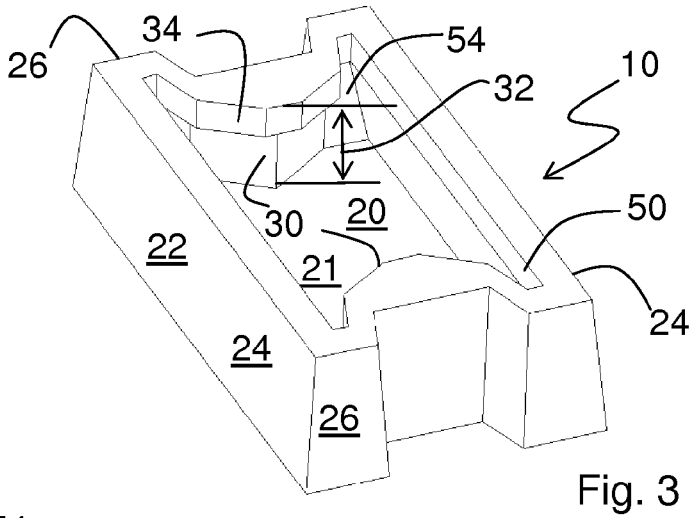
FIG. 3 is a perspective drawing of an impact pad of the present invention.

FIG. 3 shows an impact pad 10 comprising a base 20 having an impact surface 21 facing upwards towards an interior, and a wall 22 extending upwardly from base 20. The wall 22 has a longitudinal portion 24 and a latitudinal portion 26. A protrusion 30 extends inwardly, towards the center of the impact pad, from latitudinal portion 26. Protrusion height 32 is the distance between the impact pad impact surface 21 and the top of protrusion 30. Overhang 34 extends horizontally inwards from the top of wall 22. Flow channel 50 is formed within an angle produced by the convergence of the interior of a longitudinal portion 24 and protrusion 30, and is partially closed at an end distal to the center of the interior of the impact pad. Flow riser 54, located within a flow channel, is a portion of the floor of flow channel 50 that increases in elevation as it extends towards the partially closed end of the flow channel.

Figure 4:
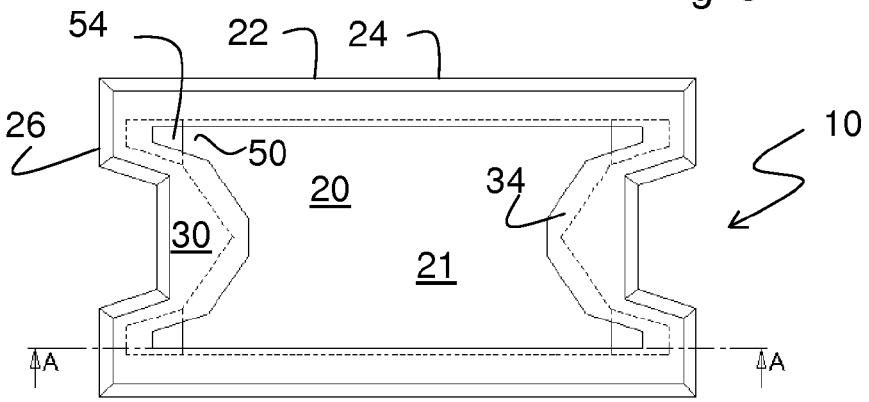
FIG. 4 is a plan view of an impact pad of the present invention.

FIG. 4 provides a plan view of embodiment of the invention with flow risers. Base 20 has an impact surface 21; wall 22 extends upwardly from the impact surface 21. Wall 22 is composed of longitudinal portions 24 and latitudinal portions 26. A pair of protrusions 30 extends inwardly, towards the center of the impact pad, each from latitudinal portions 26. Overhang 34 extends horizontally inwards from the top of wall 22. Flow channel 50 is formed within an angle produced by the convergence of the interior of a longitudinal portion 24 and protrusion 30. In this embodiment of the invention, successive segments of the protrusion 30 form successively smaller angles with the interior of longitudinal portion 24 as longitudinal portion 24 and protrusion 30 converge. In this embodiment of the invention, longitudinal portion 24 and protrusion 30 do not intersect; instead, longitudinal portion 24 and protrusion 30 each intersect an interior surface of latitudinal portion 26 of impact pad wall 22. Flow channel 50 is partially closed at an end distal to the center of the interior of the impact pad. Flow riser 54, located within a flow channel, is a portion of the floor of flow channel 50 that increases in elevation as it extends towards the partially closed end of the flow channel.

Figure 5:
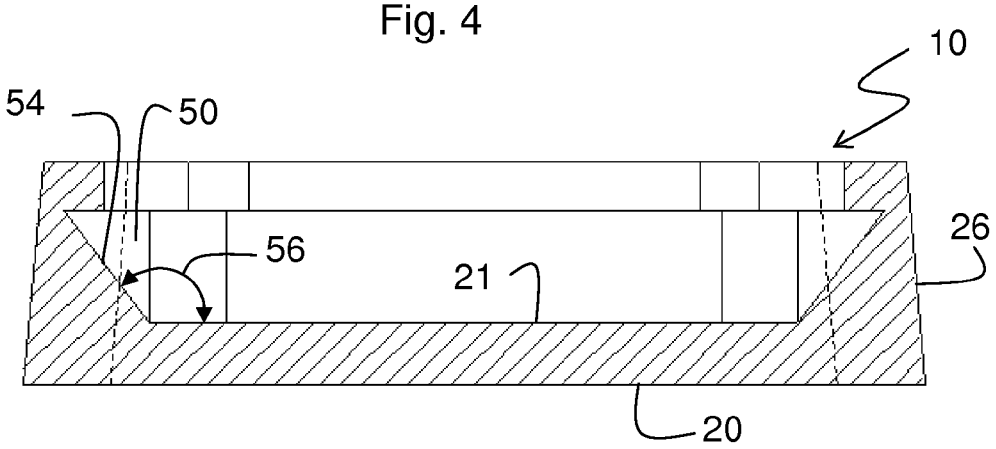
FIG. 5 is a cross section view of an impact pad of the present invention.

FIG. 5 represents a cross section, along section line AA in FIG. 4, of an impact pad 10 of the present invention, containing base 20, on which impact surface 21 is located. Latitudinal wall portion 26 is a portion of a wall extending upwardly from base 20. Flow channel 50 is in communication with the interior of impact pad 10. A portion of the floor of flow channel 50 describes an angle with impact surface 21. This angle 56 is within the range of 90 to 180 degrees, may be within the ranges of 110 degrees to 160 degrees, 120 degrees to 150 degrees, and may have, for example, a value of 115, 120, 125, 127, 130, 135, 140, 145, 150 or 155 degrees.

Figure 6:
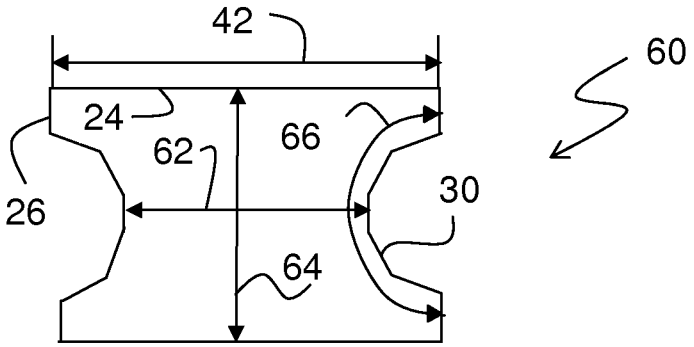
FIG. 6 is a plan view of the interior of the wall of an impact pad of the present invention.

FIG. 6 shows a plan view of the interior 60 of the wall of an impact pad of the present invention. Certain embodiments of the present invention are distinguished by having a central longitudinal minimum dimension 62, measured between opposite protrusions 30 or between a protrusion 30 and a protrusionless latitudinal portion 26, so that the longitudinal minimum dimension 62 is less than the interior longitudinal extent 42 of impact pad wall 22. Certain embodiments of the present invention are also distinguished by having a central latitudinal dimension 64, measured between opposite longitudinal wall portions 24, and a protrusion 30 having a protrusion surface length 66 measured along the surface of the protrusion from two intersections of the protrusion with latitudinal wall portion 26, so that central latitudinal dimension 64 is less than protrusion surface length 66. In the embodiment shown in this figure, the inwardly-facing surface of protrusion 30 is composed of a series of adjoining rectangular planar surfaces.

Figure 7:
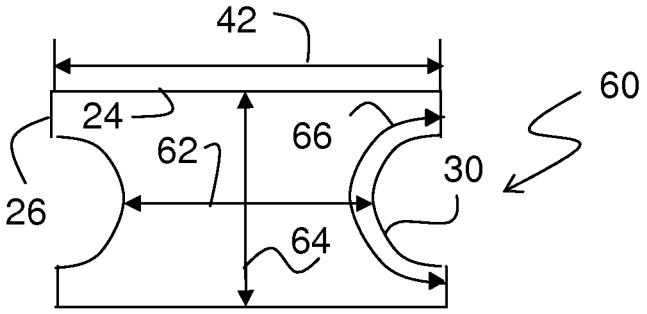
FIG. 7 is a plan view of the interior of the wall of an impact pad of the present invention.

FIG. 7 shows a plan view of the interior 60 of the wall of an impact pad of the present invention. Certain embodiments of the present invention are distinguished by having a central longitudinal minimum dimension 62, measured between opposite protrusions 30 or between a protrusion 30 and a protrusionless latitudinal portion 26, so that the longitudinal minimum dimension 62 is less than the interior longitudinal extent 42 of impact pad wall 22. Certain embodiments of the present invention are also distinguished by having a central latitudinal dimension 64, measured between opposite longitudinal wall portions 24, and a protrusion 30 having a protrusion surface length 66 measured along the surface of the protrusion from two intersections of the protrusion with latitudinal wall portion 26, so that central latitudinal dimension 64 is less than protrusion surface length 66. In the embodiment shown in this figure, the inwardly-facing surface of protrusion 30 is in the form of a portion of the radial surface of a cylinder. In the embodiment shown in this figure, the convergence of the interior of a longitudinal portion 24 and protrusion 30 leads to the intersection of longitudinal portion 24 with a latitudinal wall portion 26 and the intersection of protrusion 30 with a latitudinal wall portion 26, at which points the interior surfaces of longitudinal portion 24 and protrusion 30 are parallel.

Figure 8:
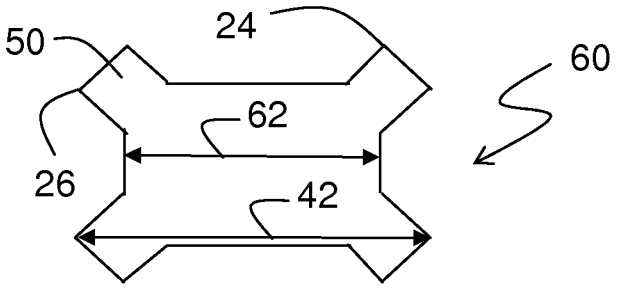
FIG. 8 is a plan view of the interior of the wall of an impact pad of the present invention.

FIG. 8 shows a plan view of the interior 60 of the wall of an impact pad of the present invention. In the embodiment depicted, both the longitudinal portions 24 and the latitudinal portions 26 of the wall have protrusions. Interior longitudinal extent 42 of the wall is greater than the central longitudinal minimum dimension 62.

Figure 9:
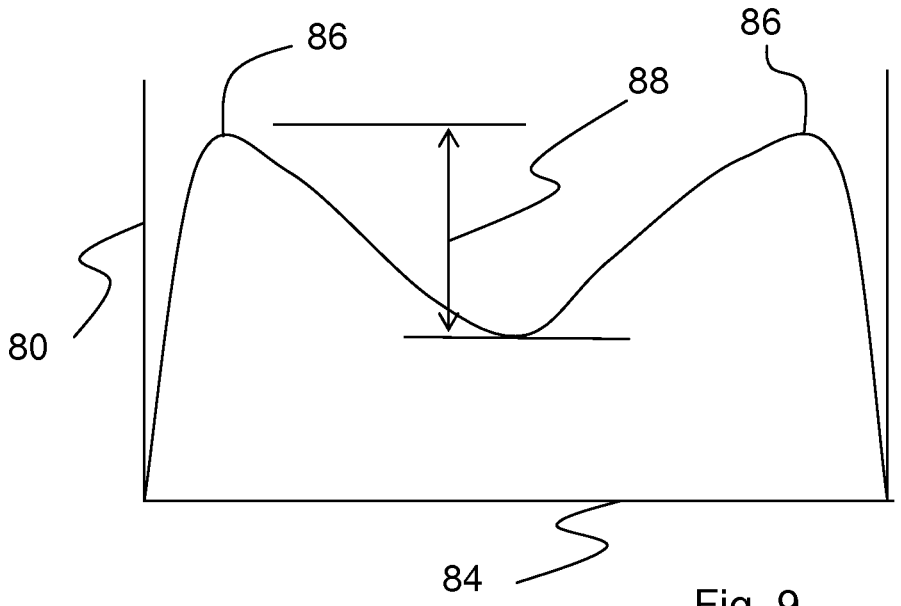
FIG. 9 is a plot of flow velocities of molten metal flowing over a latitudinal wall of an impact pad of the present invention plotted as a function of distance along the latitudinal wall.

FIG. 9 depicts the flow velocity 80 plotted against latitudinal distance 84 over a latitudinal portion of the wall of an impact pad depicted in FIGS. 1 and 2. Above the flow channels, flow velocity is increased. Above the protrusion, the flow velocity is decreased. The pattern of flow exhibits maxima 86 above the flow channels and a local minimum 88 above the protrusion.

Figure 10:
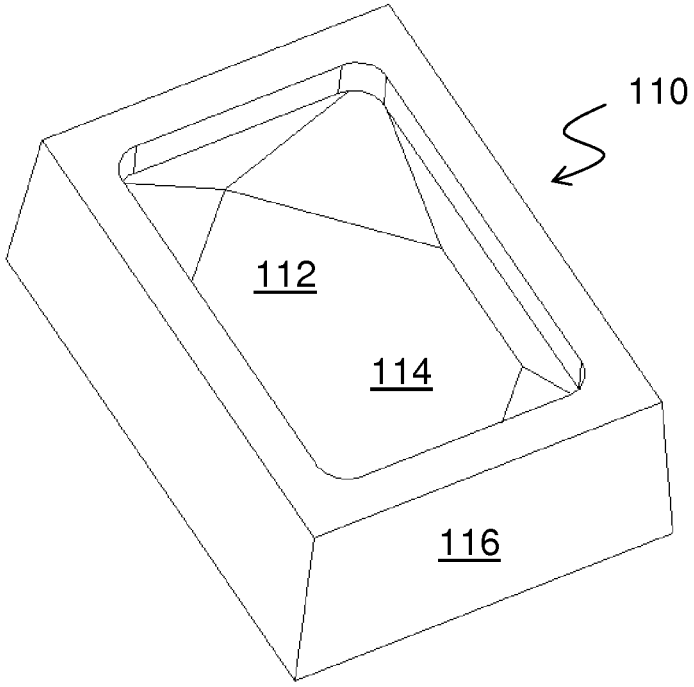
Fig. 10 PRIOR ART
FIG. 10 is a perspective view of an impact pad of the prior art.

FIG. 10 is a perspective view of impact pad 110 of prior art. The pad contains a base 112 with an impact surface 114 facing upwardly and facing the interior of the impact pad. A wall extends upwardly around the periphery of the base. The prior art impact pad contains no protrusion from a latitudinal wall, and no flow channel according to the definition of those terms as used to describe the present invention.

Figure 11:
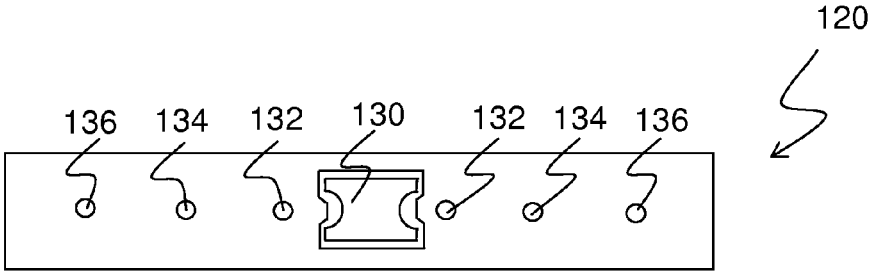
FIG. 11 is a plan view of a multi-strand tundish containing an impact pad.

FIG. 11 is a plan representation of a casting tundish 120. Impact pad 130 is placed in the tundish; molten metal flow into the tundish is arranged so that molten metal flows into impact pad 130. Molten metal flows from the tundish into pairs of casting strands. Outlets for casting strands 132 are closest to the impact pad 130; outlets for casting strands 134 are at an intermediate distance from the impact pad 130; outlets for casting strands 136 are at the farthest distance from the impact pad 130.

Figure 12:
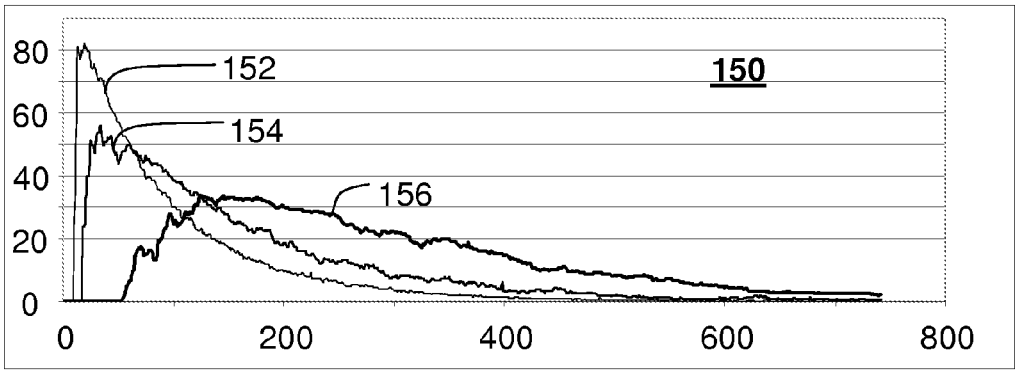
Fig. 12 PRIOR ART
FIG. 12 is a plot of flow volumes exiting a tundish as a function of time in a tundish containing an impact pad of the prior art.

FIG. 12 depicts the performance of impact pad 110 of prior art. A model of a multi-strand tundish according to FIG. 11 was constructed so that flow of water containing tracer dye could be used to study flow patterns. In the experiment reported in FIG. 12, a model of a prior art impact pad according to FIG. 10 was introduced, and the tundish model was filled with water containing no die. At time zero a pulse of tracer dye was injected into the inlet flow of water. This flow impacted the pad and dispersed throughout the tundish. As the water/dye mix simultaneously exited the tundish model through six different outlets a transmittance value was recorded1 at three locations, each location corresponding to one of the outlets of the outlet pairs depicted in FIG. 11. Plot 150 indicates values for light transmitted through a mixture of water and tracer dye. On plot 150 a transmittance value of zero indicates water containing no dye. Higher transmittance values indicate higher quantities of dye in the mix. The ordinate or vertical axis in plot 150 represents the transmittance values observed. The abscissa or horizontal axis in plot 150 represents time, in seconds, from the introduction of tracer dye to the system.

Results of the analysis are shown in graph 150. The sensor at position 132, producing results indicated by plot 152, was located 2.16 inches from the exterior of the latitudinal wall of the impact pad. The sensor at position 134, producing results indicated by plot 154 was located 16.16 inches from the exterior of the latitudinal wall of the impact pad. The sensor at position 136, producing results indicated by plot 156, was located 30.16 inches from the exterior of the latitudinal wall of the impact pad.

With prior art impact pad 110 there is a wide deviation in values among the three plots at a given time. Also, minimum residence time (MRT), as indicated by the time when the plot begins to rise, is a very short at location 132 and long at location 136.

Figure 13:
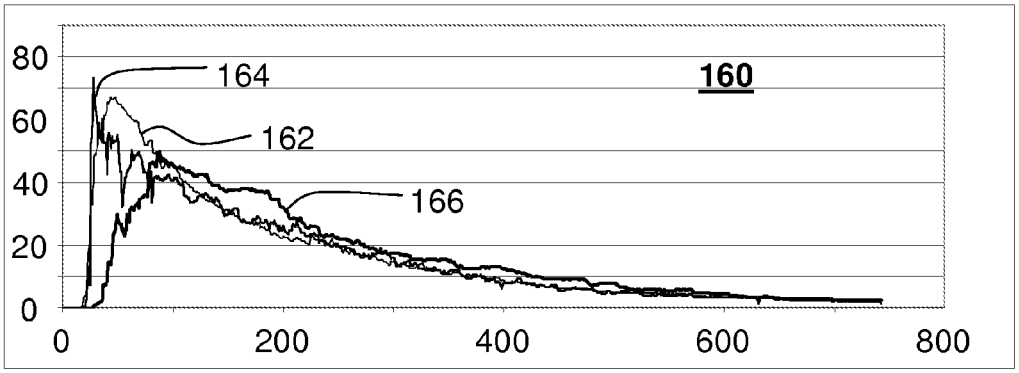
FIG. 13 is a plot of flow volumes exiting a tundish as a function of time in a tundish containing an impact pad of the present invention.

FIG. 13 depicts the performance of an impact pad 10 of the present invention, containing two protrusions, four flow channels, and a flow riser in each of the flow channels. A model of a multi-strand tundish according to FIG. 11 was constructed so that flow of water containing tracer dye could be used to study flow patterns. In the experiment reported in FIG. 13, a model of an impact pad 10 according to FIG. 1 was introduced, and the tundish model was filled with water containing no die. At time zero a pulse of tracer dye was injected into the inlet flow of water. This flow impacted the pad and dispersed throughout the tundish. As the water/dye mix simultaneously exited the tundish model through six different outlets a transmittance value was recorded at three locations, each location corresponding to one of the outlets of the outlet pairs depicted in FIG. 11. Plot 160 indicates values for light transmitted through a mixture of water and tracer dye. On plot 160 a transmittance value of zero indicates water containing no dye. Higher transmittance values indicate higher quantities of dye in the mix. The ordinate or vertical axis in plot 160 represents the transmittance values observed. The abscissa or horizontal axis in plot 160 represents time, in seconds, from the introduction of tracer dye to the system.

Results of the analysis are shown in graph 160. The sensor at position 132, producing results indicated by plot 162, was located 2.16 inches from the exterior of the latitudinal wall of the impact pad. The sensor at position 134, producing results indicated by plot 164, was located 16.16 inches from the exterior of the latitudinal wall of the impact pad. The sensor at position 136, producing results indicated by plot 166, was located 30.16 inches from the exterior of the latitudinal wall of the impact pad.

The impact pad used to produce the results depicted in graph 160 directs the flow in such a way that the deviation in values among the three plots was significantly narrower at a given time than was observed for the prior art impact pad. For the present invention, MRT at location 132 was substantially increased while at the same time MRT at location 136 was reduced. This effect yields a greatly improved uniformity of water/dye concentration throughout the tundish model. For industrial applications, uniformity in MRT enables a more rapid changeover from one grade of steel to another in a multi-strand tundish.

Numerous modifications and variations of the present invention are possible. It is, therefore, to be understood that within the scope of the following claims, the invention may be practiced otherwise than as specifically described.

I claim:

1. A tundish impact pad formed from refractory material comprising a base having an impact surface which, in use, faces upwardly against a stream of molten metal entering a tundish, and a wall extending upwardly from the base around at least a part of the periphery of the impact surface, the base and the wall defining an interior, the pad having a longitudinal central minimum extent, the wall having a longitudinal portion having an interior, an internal extent and an internal length, and a latitudinal portion having an interior, an internal extent and an internal length, wherein the internal extent of the longitudinal portion of the wall is greater than the longitudinal central minimum extent of the pad, wherein the internal length of the latitudinal portion of the wall is greater than the internal extent of the latitudinal portion of the wall, wherein a protrusion having a width, a height and an interior surface extends inwardly from the latitudinal portion of the wall into the interior, and wherein the height of the protrusion is equal to the height of the portion of the latitudinal portion of the wall with which it is in contact.

2. A tundish impact pad according to claim 1, wherein the wall extends around the entire periphery of the base.

3. A tundish impact pad according to claim 2, wherein the wall is of uniform height.

4. A tundish impact pad according to claim 1, wherein the base is square, rectangular or trapezoidal.

5. A tundish impact pad according to claim 1, wherein the tundish produces flow velocities in molten metal leaving the impact pad, and wherein flow velocities measured along the top of the length of the latitudinal portion of the wall exhibit a minimum at a central portion of the latitudinal portion of the wall.

6. A tundish impact pad according to claim 1, wherein the interior surface of the protrusion intersects the interior of the latitudinal portion of the wall at an angle greater than 90 degrees.

7. A tundish impact pad according to claim 1, wherein the interior surface of the protrusion comprises at least one quadrilateral surface.

8. A tundish impact pad according to claim 1, wherein the interior surface of the protrusion comprises a portion having the form of a portion of a radial surface of a cylinder.

9. A tundish impact pad according to claim 1, wherein the ratio of the width of the protrusion to the height of the protrusion is 1 or greater.

10. A tundish impact pad according to claim 1, wherein the ratio of the extent of the protrusion to the width of the protrusion is in the range from, and including, 0.3 to, and including, 3.0.

11. A tundish impact pad according to claim 1, wherein the ratio of the width of the protrusion to the height of the protrusion is in the range from, and including 0.8 to, and including, 1.5.

12. A tundish impact pad according to claim 1, wherein the ratio of the width of the protrusion to the internal extent of the latitudinal wall of the impact pad is in the range from, and including 0.1 to, and including, 1.

13. A tundish impact pad according to claim 1, wherein the interior surface of the protrusion and the interior surface of the longitudinal portion of the wall converge to form a flow channel having a floor, and having an end distal to the center of the impact pad.

14. A tundish impact pad, according to claim 13, wherein the angle formed by the interior surface of the protrusion and the interior surface of longitudinal portion of the wall decreases towards the distal end of the flow channel.

15. A tundish impact pad according to claim 13, wherein the flow channel increases in elevation as it extends towards the end distal to the center of the impact pad.

16. A tundish impact pad according to claim 15, wherein the floor of the flow channel forms an angle less than 180 degrees with the impact surface of the impact pad.

17. A tundish impact pad according to claim 16, wherein the floor of the flow channel forms an angle in the range from, and including 115 degrees to, and including 155 degrees with the impact surface of the impact pad.

18. A tundish impact pad according to claim 17, wherein the floor of the flow channel forms an angle of 127 degrees with the impact surface of the impact pad.

* * * * *